US010501096B2

(12) United States Patent
Chen et al.

(10) Patent No.: US 10,501,096 B2
(45) Date of Patent: Dec. 10, 2019

(54) ENGINEERING VEHICLE HAVING BALLAST UNLOADING DEVICE AND BALLAST LEVELING DEVICE

(71) Applicant: CRRC YANGTZE CO., LTD., Wuhan (CN)

(72) Inventors: Wei Chen, Wuhan (CN); Liangcai Lin, Wuhan (CN); Chuqiang Tang, Wuhan (CN); Baolei Wang, Wuhan (CN); Junxiang Liu, Wuhan (CN); Xuefeng Yin, Wuhan (CN); Qingping Lei, Wuhan (CN); Rui Chen, Wuhan (CN); Feng Shi, Wuhan (CN); Wei Sui, Wuhan (CN); Kun Mei, Wuhan (CN); Nan Zhang, Wuhan (CN); Yan He, Wuhan (CN); Luyao He, Wuhan (CN)

(73) Assignee: CRRC YANGTZE CO., LTD., Wuhan (CN)

( * ) Notice: Subject to any disclaimer, the term of this patent is extended or adjusted under 35 U.S.C. 154(b) by 278 days.

(21) Appl. No.: 15/521,877

(22) PCT Filed: Oct. 22, 2015

(86) PCT No.: PCT/CN2015/092525
§ 371 (c)(1),
(2) Date: Apr. 25, 2017

(87) PCT Pub. No.: WO2016/070714
PCT Pub. Date: May 12, 2016

(65) Prior Publication Data

US 2017/0327130 A1 Nov. 16, 2017

(30) Foreign Application Priority Data

Nov. 3, 2014 (CN) ..... 2014 1 0611687

(51) Int. Cl.
*B61D 7/32* (2006.01)
*B61D 7/12* (2006.01)
*B61D 7/26* (2006.01)

(52) U.S. Cl.
CPC ..... *B61D 7/32* (2013.01); *B61D 7/12* (2013.01); *B61D 7/26* (2013.01)

(58) Field of Classification Search
CPC ... B61D 7/32; B61D 7/04; B61D 7/12; B61D 7/18; B61D 7/26; B61D 7/28
See application file for complete search history.

(56) References Cited

U.S. PATENT DOCUMENTS 9,950,713 B2 * 4/2018 Senn ..... B61D 7/02
2002/0073882 A1 * 6/2002 Howard ..... B61D 7/32 105/247

(Continued)

FOREIGN PATENT DOCUMENTS

CN 203713880 U 7/2014
CN 104060507 A 9/2014

(Continued)

*Primary Examiner* — Jason C Smith
(74) *Attorney, Agent, or Firm* — Platinum Intellectual Property LLP

(57) ABSTRACT

The invention provides an engineering vehicle having a ballast unloading device (100) and a ballast leveling device (200). The engineering vehicle includes a vehicle body (10), and the ballast unloading device (100) and the ballast leveling device (200) arranged on the vehicle body (10). The ballast unloading device (100) includes: a ballast carrying portion (20) provided with ballast unloading openings (21), and the ballast carrying portion (20) being arranged on the vehicle body (10); ballast unloading doors (30) capable of rotating relative to the ballast carrying portion (20), inner unloading passages (31) and outer unloading passages (32) being arranged on the ballast unloading doors (30), the ballast unloading doors (30) further including stop portions (Continued)

(33) located between the inner unloading passages (31) and the outer unloading passages (32). The ballast leveling device (200) includes: a plough piece (220) slidably fixed to the vehicle body (10) so as to ascend or descend relative to the vehicle body (10), and a plough head (224) used for leveling ballasts being arranged on the plough piece (220); a first crank (230) rotationally fixed to the vehicle body (10); a connecting rod (240), with one end being rotationally connected with the first crank (230), and the other end being rotationally connected with the plough piece (220); and a driving part (250) used for driving the first crank (230) to rotate.

10 Claims, 7 Drawing Sheets

(56) References Cited

U.S. PATENT DOCUMENTS

2010/0251923 A1* 10/2010 Forbes ..... B61D 7/04
105/253
2011/0219981 A1* 9/2011 Brandt ..... B61D 7/30
105/241.2
2012/0199042 A1* 8/2012 Dalske ..... B61D 7/02
105/248
2012/0210906 A1* 8/2012 Gaydos ..... B61D 7/26
105/285
2014/0261069 A1* 9/2014 Bis ..... B61D 7/18
105/251
2014/0271071 A1* 9/2014 Aaron ..... B61D 7/32
414/528
2014/0360056 A1* 12/2014 Spurlock ..... E01B 27/025
37/104
2016/0001788 A1* 1/2016 Gibney ..... B61D 7/32
105/247
2017/0096778 A1* 4/2017 Landes ..... B61D 7/02
2017/0327130 A1* 11/2017 Chen ..... B61D 7/12
2018/0201278 A1* 7/2018 Brown ..... B61D 7/02

FOREIGN PATENT DOCUMENTS

CN 104085405 A 10/2014
CN 104325986 A 2/2015
CN 204161373 U 2/2015
CN 104386076 A 3/2015
CN 204279433 U 4/2015

* cited by examiner

ENGINEERING VEHICLE HAVING BALLAST UNLOADING DEVICE AND BALLAST LEVELING DEVICE

FIELD OF THE INVENTION

The present invention relates to the technical field of rail transport means, and in particular to an engineering vehicle having a ballast unloading device and a ballast leveling device.

BACKGROUND OF THE INVENTION

A railway ballast car is an engineering vehicle, which is used for transporting railway stone ballasts, building new rail tracks and paving ballasts on the existing rail tracks for maintenance, and is specifically used for paving stone ballasts in the construction of the newly-built rail tracks and maintaining the existing rail tracks. In order to improve the railway transport efficiency and greatly shorten the track pavement and maintenance time, higher requirements are proposed for the transport operation efficiency and the operation safety of the railway ballast car.

During the ballast pavement of the existing railway ballast car, the existing railway ballast car can unload the ballast while moving, and also has the function of unloading the ballasts to the inner and outer sides of the tracks. During the ballast pavement of the newly-built railways, the ballasts are required to be unloaded to the inner and outer sides of the tracks at the same time, the ballasts are dispersed evenly, and during the ballast pavement in the maintenance of the existing tracks, the ballast supplement amounts on the inner and outer sides of the tracks are different. Therefore, the railway ballast car is provided with ballast unloading openings on both sides and the middle of the tracks, and each ballast unloading opening is provided with a ballast unloading door used for closing the ballast unloading opening.

In other words, in the prior art, in order to unload the ballasts to the inner sides of the tracks and unload the ballasts to the outer sides of the tracks, inner ballast unloading openings for unloading the ballasts to the inner sides of the tracks and outer ballast unloading openings for unloading the ballasts to the outer sides of the tracks must be provided, and the ballasts cannot be both unloaded to the inner sides of the tracks and the outer sides of the tracks by one ballast unloading opening.

In addition, the ballast pavement amount or the ballast supplement amount is difficult to control in a ballast pavement process or a ballast supplement process, resulting in excessive or insufficient local ballast pavement or ballast supplement, and if excessive ballasts are supplemented or the ballasts are supplemented close to steel rails, ballasts may be accumulated on the planes of the steel rails, which causes vehicle accidents.

The current solution is a manual ballast leveling mode, but the method has the technical problems of large labor intensity, low efficiency, harsh environment (much dust, susceptibility to weather effects), etc.

SUMMARY OF THE INVENTION

The present invention provides an engineering vehicle having a ballast unloading device and a ballast leveling device for solving the technical problems that in order to unload ballasts to inner sides of tracks and unload ballasts to outer sides of the tracks, inner ballast unloading openings for unloading the ballasts to the inner sides of the tracks and outer ballast unloading openings for unloading the ballasts to the outer sides of the tracks must be provided, the ballasts cannot be both unloaded to the inner sides of the tracks and the outer sides of the tracks by one ballast unloading opening, and that the ballasts need to be leveled in an manual ballast leveling mode, resulting in large labor intensity, low efficiency and harsh environment.

The present invention provides an engineering vehicle having a ballast unloading device and a ballast leveling device. The engineering vehicle includes a vehicle body, and the ballast unloading device and the ballast leveling device arranged on the vehicle body, the ballast unloading device includes: a ballast carrying portion provided with ballast unloading openings, and the ballast carrying portion being arranged on the vehicle body; ballast unloading doors capable of rotating relative to the ballast carrying portion, inner unloading passages and outer unloading passages being arranged on the ballast unloading doors, and the ballast unloading doors further including stop portions located between the inner unloading passages and the outer unloading passages; wherein by means of the rotation of the ballast unloading doors relative to the ballast carrying portion, the ballast unloading doors can switch among three states that the inner unloading passages are opposite to the ballast unloading openings, the outer unloading passages are opposite to the ballast unloading openings, and that the stop portions are arranged on the ballast unloading openings; and the ballast leveling device includes: a plough piece slidably fixed to the vehicle body so as to ascend or descend relative to the vehicle body, and a plough head used for leveling ballasts being arranged on the plough piece; a first crank rotationally fixed to the vehicle body; a connecting rod, with one end being rotationally connected with the first crank, and the other end being rotationally connected with the plough piece; and a driving part used for driving the first crank to rotate so as to drive the plough piece to ascend or descend through the connecting rod, in order to drive the plough head to ascend or descend.

Preferably, the ballast unloading door includes two opposite end plates and two ballast flow plates connected with the two end plates, wherein one ballast flow plate and the two end plates are enclosed to form the inner unloading passage, and the other ballast flow plate and the two end plates are enclosed to form the outer unloading passage.

Preferably, the stop portions are specifically top plates connected with the two ballast flow plates, and a plurality of division plates are arranged between the two ballast flow plates at intervals.

Preferably, the ballast unloading device further includes acoustic boards, and the acoustic boards are fixed to the end plates and the ballast flow plates.

Preferably, the ballast unloading device further includes a transmission shaft and a second crank in fixed connection with the transmission shaft, the transmission shaft is fixed to the ballast unloading doors, and power is transmitted to the transmission shaft by the second crank to drive the transmission shaft to rotate so as to drive the ballast unloading doors to rotate.

Preferably, the driving part is a hydraulic cylinder, and the movement direction of a piston rod of the hydraulic cylinder is vertical to the movement direction of the plough piece.

Preferably, the plough head is detachably fixed to the plough piece, and the thickness of the end part of the plough head away from the plough piece is smaller than the thickness of the end part of the plough head connected with the plough piece.

Preferably, two guide slots are formed in the vehicle body, two guide rail groups are arranged on the plough piece, the two guide rail groups are respectively arranged in the two guide slots so as to slidably fix the plough piece to the vehicle body, and a wearing plate is arranged between the guide rail groups to improve the abrasive resistance of the plough piece when sliding relative to the vehicle body.

Preferably, a fixing hole is formed in the vehicle body, a locking hole is formed in the plough piece, the ballast leveling device further includes a lock pin, after the plough piece ascends relative to the vehicle body, the fixing hole is opposite to the locking hole, and the lock pin is inserted into the fixing hole and the locking hole to relatively fix the vehicle body and the plough piece.

Preferably, the ballast leveling device further includes a sweeper, the sweeper is used for sweeping steel rails, the sweeper is fixed to the plough piece, and when the plough piece descends, the sweeper descends to sweep the steel rails.

The present invention has the following beneficial effects:

According to the ballast unloading device of the above-mentioned engineering vehicle, by means of one ballast unloading opening, and the ballast unloading doors provided with the inner unloading passages and outer unloading passages and including the stop portions located between the inner unloading passages and the outer unloading passages, and by means of the rotation of the ballast unloading doors relative to the ballast carrying portion, the ballast unloading device can be located at an inner unloading position, an outer unloading position or a door closing position, that is to say, the ballast unloading openings can both unload the ballasts to the inner sides of the tracks and unload the ballasts to the outer sides of the tracks through the ballast unloading doors, thereby solving the technical problem that in order to unload the ballasts to the inner sides of the tracks and unload the ballasts to the outer sides of the tracks, inner ballast unloading openings for unloading the ballasts to the inner sides of the tracks and outer ballast unloading openings for unloading the ballasts to the outer sides of the tracks must be provided, and that the ballasts cannot be both unloaded to the inner sides of the tracks and the outer sides of the tracks by one ballast unloading opening. In addition, when ballast leveling is required, the driving part is started to drive the crank to rotate so as to drive the plough piece to descend through the connecting rod, so the plough head descends, the vehicle body moves, and the plough head can level the ballasts without requiring manual ballast leveling, thereby solving the technical problem in the prior art that the ballasts are leveled in the manual ballast leveling mode, resulting in large labor intensity, low efficiency and harsh environment.

The foregoing description is merely an overview of the technical solutions of the present invention and can be implemented in accordance with the contents of the description in order to enable a clearer understanding of the technical means of the present invention, and to make the above-mentioned and other objectives, features and advantages of the present invention be more obvious, specific embodiments of the present invention will be described hereinafter.

BRIEF DESCRIPTION OF THE DRAWINGS

Various other advantages and beneficial effects will become apparent to those of ordinary skill in the art upon reading the following detailed description of the preferred embodiments. The drawings are for the purpose of illustrating the preferred embodiments only and are not to be construed as limiting the present invention. Moreover, throughout the whole drawings, the same reference signs are used for designating the same components. In the drawings.

DETAILED DESCRIPTION OF THE EMBODIMENTS

Figure 1:
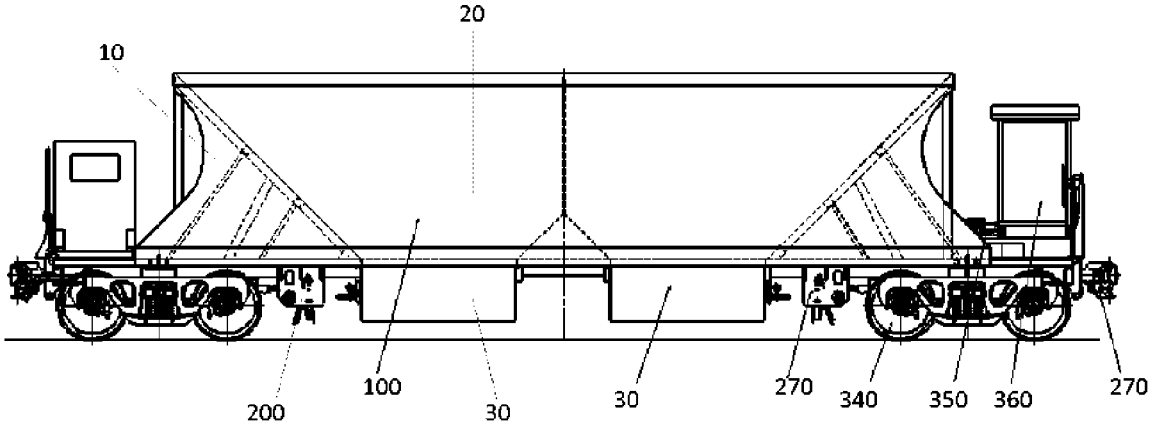
FIG. 1 is a structural schematic diagram of an engineering vehicle having a ballast unloading device and a ballast leveling device in a first preferred embodiment of the present application.

Exemplary embodiments of the present disclosure will be described in more detail below with reference to the drawings. Although the exemplary embodiments of the present disclosure are shown in the drawings, it should be understood that the present disclosure may be embodied in various forms and should not be limited to the embodiments set forth herein. On the contrary, these embodiments are provided to enable a more thorough understanding of the present disclosure and to provide a complete description of the scope of the present disclosure to those skilled in the art.

Figure 2:
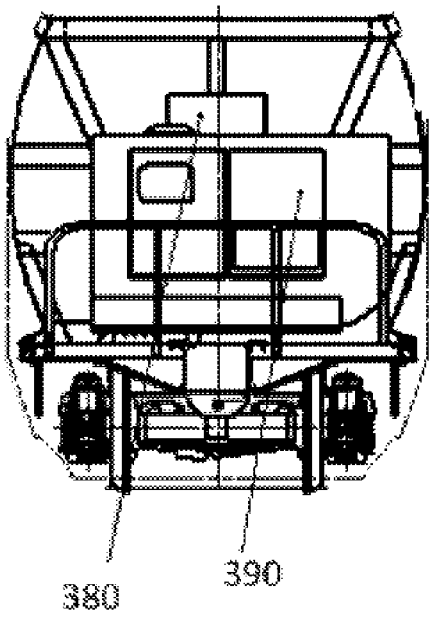
FIG. 2 is a side view of the engineering vehicle in FIG. 1.

FIG. 1 is a structural schematic diagram of an engineering vehicle having a ballast unloading device and a ballast leveling device in a first preferred embodiment of the present application. As shown in FIG. 1 and FIG. 2, the engineering vehicle includes a vehicle body 10, a ballast unloading device 100, a ballast leveling device 200, a bogie 340, a braking device 350, a hydraulic system 360, a draw gear buffering device 370, a remote control device 380 and a diesel generator set 390.

The ballast unloading device 100 is arranged on the vehicle body 10 and includes a ballast carrying portion 20 and ballast unloading doors 30.

The ballast carrying portion 20 is provided with ballast unloading openings 21, and the ballast unloading openings 21 are used for unloading ballasts. The number of the ballast unloading openings 21 can be determined according to needs. The ballast carrying portion 20 is arranged on the vehicle body 10.

Figure 3:
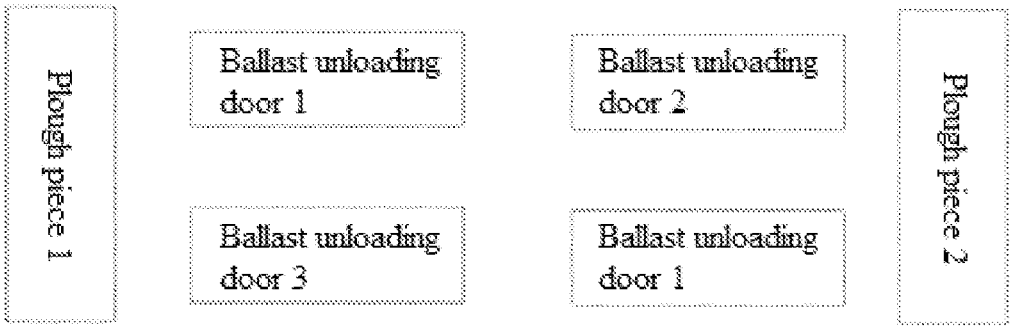
FIG. 3 is a partial schematic diagram of a plough piece and a ballast unloading door of the engineering vehicle in FIG. 1.
Figure 4:
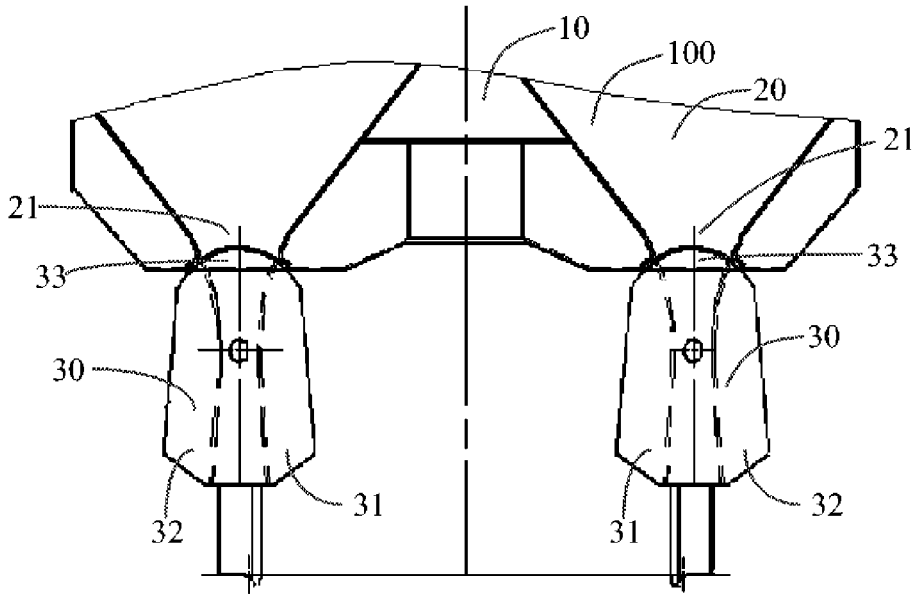
FIG. 4 is a structural schematic diagram of the ballast unloading device of the engineering vehicle in FIG. 1.
Figure 5:
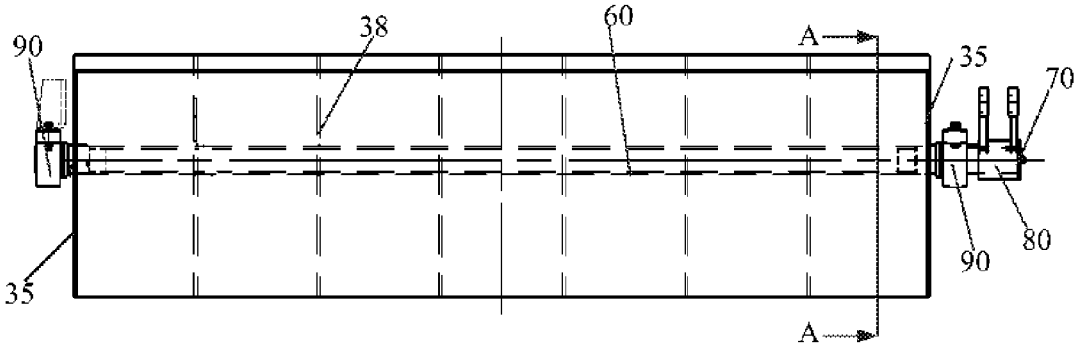
FIG. 5 is a structural schematic diagram of the ballast unloading door of the ballast unloading device in FIG. 4.
Figure 6:
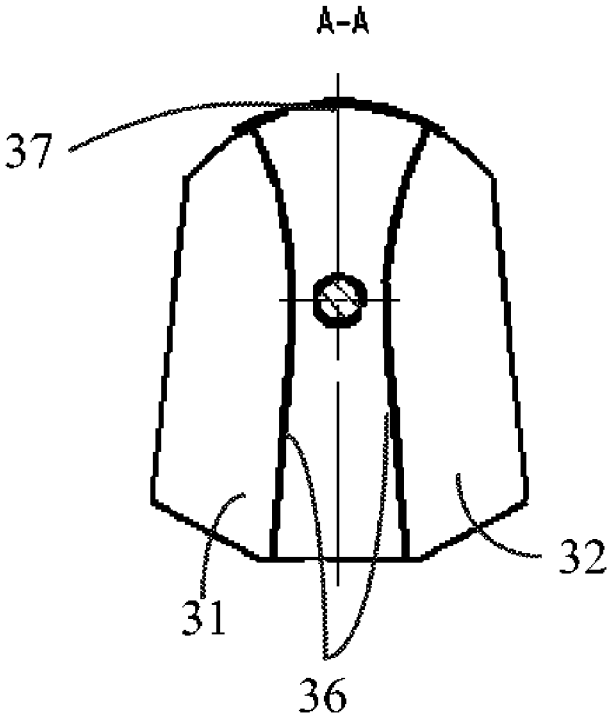
FIG. 6 is a side view of the ballast unloading door in FIG. 5.

Meanwhile please refer to FIG. 4 and FIG. 6, the ballast unloading doors 30 are arranged on the vehicle body 10 and can rotate relative to the ballast carrying portion 20. The number of the ballast unloading doors 30 can be determined according to the number of the ballast unloading openings 21. For example, if the number of the ballast unloading openings 21 is 4, the number of the ballast unloading doors 30 is also set as 4; and as another example, if the number of the ballast unloading openings 21 is 4, but one of the unloading openings 21 requires no closing or unloading position adjustment, the number of the ballast unloading doors 30 can be set as 3. In the present embodiment, as shown in FIG. 3, in order to guarantee simultaneous ballast unloading on the inner and outer sides of the tracks, the number of the ballast unloading openings 21 is set as 4, the number of the ballast unloading doors 30 is also set as 4, and in other embodiments, the number of the ballast unloading openings 21 and the ballast unloading doors 30 can be set according to the ballast unloading needs.

Figure 7:
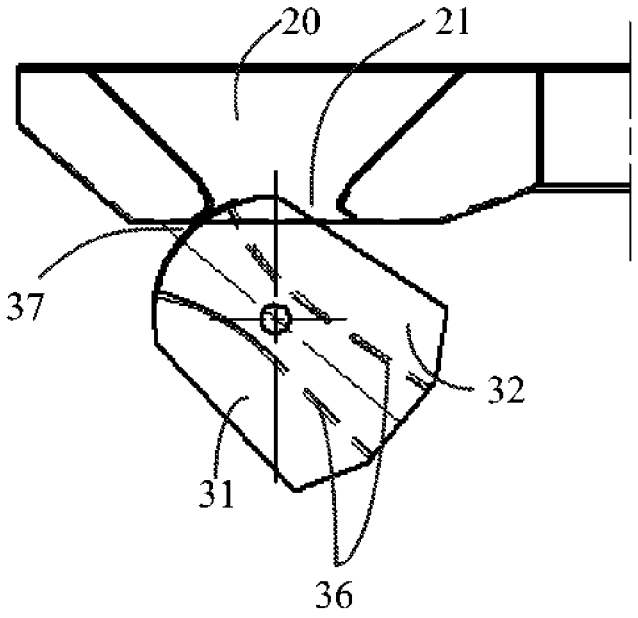
FIG. 7 is a structural schematic diagram of another state of the ballast unloading device in FIG. 4.
Figure 8:
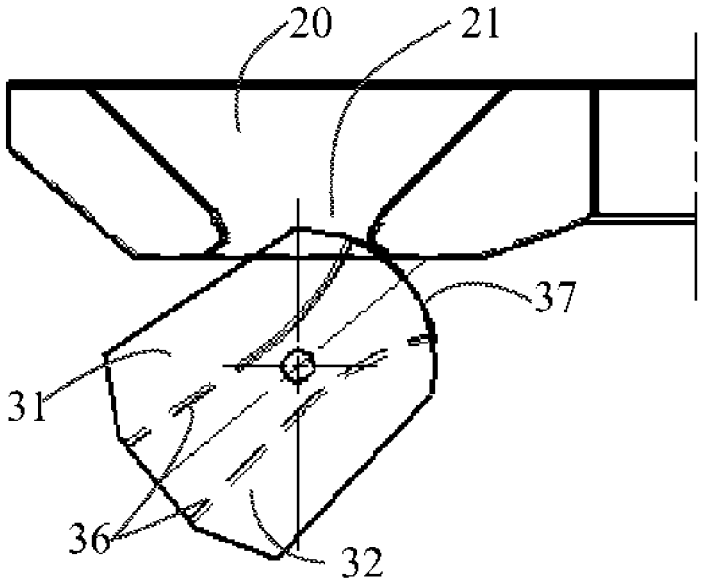
FIG. 8 is a structural schematic diagram of yet another state of the ballast unloading device in FIG. 4.

Meanwhile please refer to FIG. 7 and FIG. 8, inner unloading passages 31 and outer unloading passages 32 are arranged on the ballast unloading doors 30. The ballast unloading doors 30 further include stop portions 33 located between the inner unloading passages 31 and outer unloading passages 32. The ballast unloading doors 30 rotate relative to the ballast carrying portion 20, and the ballast unloading doors 30 can switch among three states that the inner unloading passages 31 are opposite to the ballast unloading openings 21, the outer unloading passages 32 are opposite to the ballast unloading openings 21, and that the stop portions 33 are arranged on the ballast unloading openings 21.

That is to say, the ballast unloading doors 30 have at least three states, the first state: the inner unloading passages 31 of the ballast unloading doors 30 are opposite to the ballast unloading openings 21, so the ballast unloading device 100 is located at an inner unloading position, and the ballasts in the ballast unloading device 100 can be unloaded to the inner sides of the tracks under the guide of the inner unloading passages 31; the second state: the outer unloading passages 32 of the ballast unloading doors 30 are opposite to the ballast unloading openings 21, so the ballast unloading device 100 is located at an outer unloading position, and the ballasts in the ballast unloading device 100 can be unloaded to the outer sides of the tracks under the guide of the outer unloading passages 32; and the third state: the stop portions 33 of the ballast unloading doors 30 are arranged on the ballast unloading openings 21, so the ballast unloading device 100 is located at a door closing position, and the ballast unloading device 100 stops unloading the ballasts.

That is, by means of one ballast unloading opening 21, and the ballast unloading doors 30 provided with the inner unloading passages 31 and outer unloading passages 32 and including the stop portions 33 located between the inner unloading passages 31 and the outer unloading passages 32, and by means of the rotation of the ballast unloading doors 30 relative to the ballast carrying portion 20, the ballast unloading device 100 can be located at the inner unloading position, the outer unloading position or the door closing position, that is to say, the ballast unloading openings 21 can both unload the ballasts to the inner sides of the tracks and unload the ballasts to the outer sides of the tracks through the ballast unloading doors 30, thereby solving the technical problem that in order to unload the ballasts to the inner sides of the tracks and unload the ballasts to the outer sides of the tracks, inner ballast unloading openings for unloading the ballasts to the inner sides of the tracks and outer ballast unloading openings for unloading the ballasts to the outer sides of the tracks must be provided, and that the ballasts cannot be both unloaded to the inner sides of the tracks and the outer sides of the tracks by one ballast unloading opening.

Figure 11:
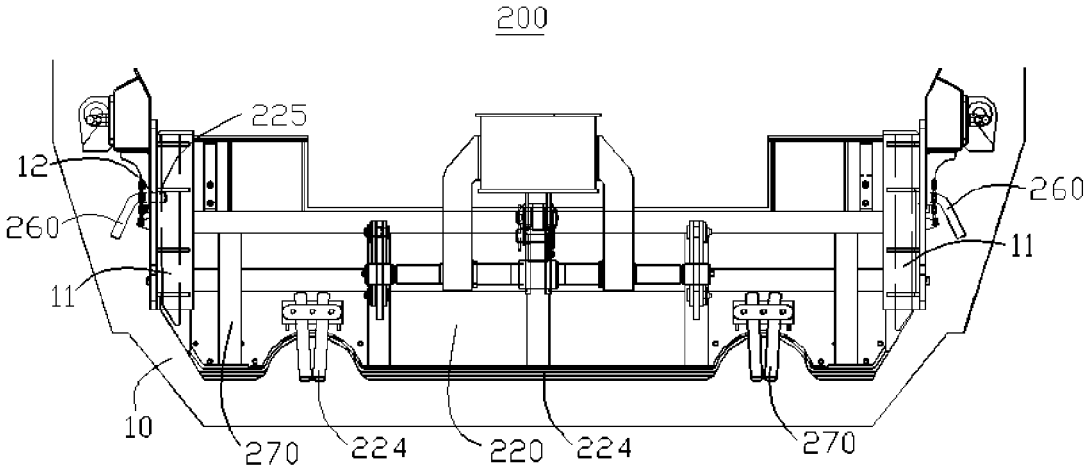
FIG. 11 is a structural schematic diagram of the ballast leveling device of the engineering vehicle in FIG. 1.
Figure 12:
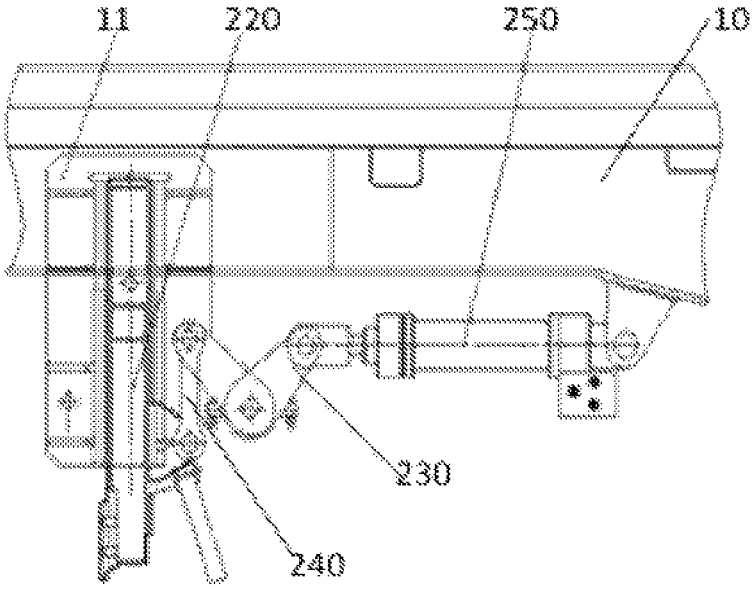
FIG. 12 is a side view of the ballast leveling device in FIG. 11.

Meanwhile please refer to FIG. 11 and FIG. 12, the ballast leveling device 200 is arranged on the vehicle body 10, and the ballast leveling device 200 is used for leveling the ballasts. The ballast leveling device 200 includes a plough piece 220, a first crank 230, a connecting rod 240 and a driving part 250.

Figure 14:
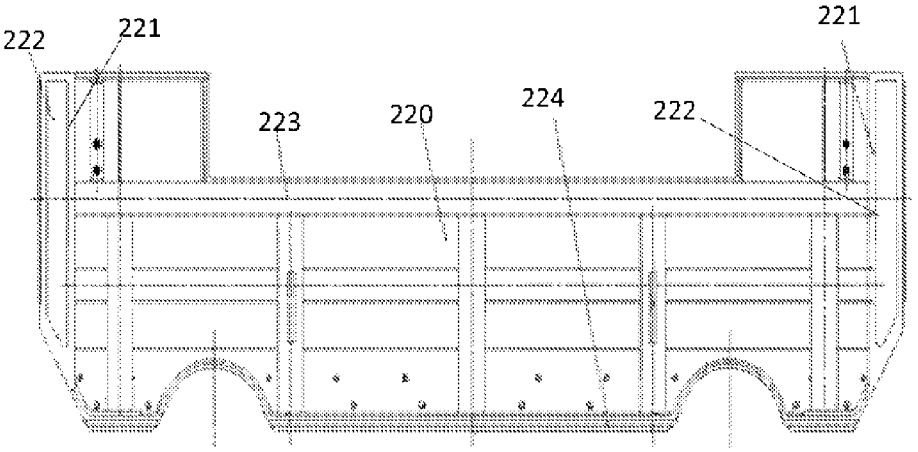
FIG. 14 is a structural schematic diagram of the plough piece of the ballast leveling device in FIG. 13.

Meanwhile please refer to FIG. 14, the plough piece 220 is slidably fixed to the vehicle body 10 so as to ascend or descend relative to the vehicle body 10. Specifically, in the present embodiment, the plough piece 220 is slidably fixed to the vehicle body 10 in the following manner: two guide slots 11 are formed in the vehicle body 10, two guide rail groups 221 are arranged on the plough piece 220, the two guide rail groups 221 are respectively arranged in the two guide slots 222 so as to slidably fix the plough piece 220 to the vehicle body 10. In other embodiments, a slide rail can be arranged between the plough piece 220 and the vehicle body 10, and the plough piece 220 slides relative to the vehicle body 10 through the slide rail.

To improve the abrasive resistance, a wearing plate 222 is arranged between the guide rail groups 221, when the plough piece 220 slides relative to the vehicle body 10, the friction dissipation of the plough piece 220 is reduced, and thus the abrasive resistance of the plough piece 220 relative to the vehicle body 10 is improved. In addition, in order to increase the strength of the plough piece 220 and reduce the breakage probability of the plough piece 220 when being applied to an acting force, a reinforcement skeleton 223 is arranged on the plough piece 220 to improve the rigidity of the plough piece 220.

A plough head 224 for leveling the ballasts is arranged on the plough piece 220. In the present embodiment, in order to conveniently replace the plough head 224, the plough head 224 is detachably fixed to the plough piece 220, in other embodiments, when the plough head 224 does not need to be detached, the plough head 224 can also be integrally formed with the plough piece 220. In addition, to conveniently insert the plough head 224 into railway ballasts for working, the thickness of the end part of the plough head 224 away from the plough piece 220 is smaller than the thickness of the end part of the plough head 224 connected with the plough piece 220, that is to say, the thickness of the end part of the plough head 224 in contact with the railway ballasts is small so as to be inserted into the railway ballasts for working.

The first crank 230 is rotationally fixed to the vehicle body 10. The first crank 230 is used for changing the direction of the acting force. In the present embodiment, preferably, the first crank is approximately L-shaped, and in other embodiments, the first crank can be set to other shapes that can change the direction of the acting force according to needs.

One end of the connecting rod 240 is rotationally connected with the first crank 230, and the other end thereof is rotationally connected with the plough piece 220. In the present embodiment, the first crank 230 and the connecting rod 240 act together to convert the movement on the horizontal direction into the movement on the vertical direction.

The driving part 250 is used for driving the first crank 230 to rotate so as to drive the plough piece 220 to ascend or descend through the connecting rod 240, in order to drive the plough head 224 to ascend or descend. In the present embodiment, the driving part 250 is specifically a hydraulic cylinder, and in other embodiments, the driving part 250 can be a motor, a gear and a gear rack. In addition, in the present embodiment, the movement direction of a piston rod of the hydraulic cylinder is vertical to the movement direction of the plough piece 220.

Figure 13:
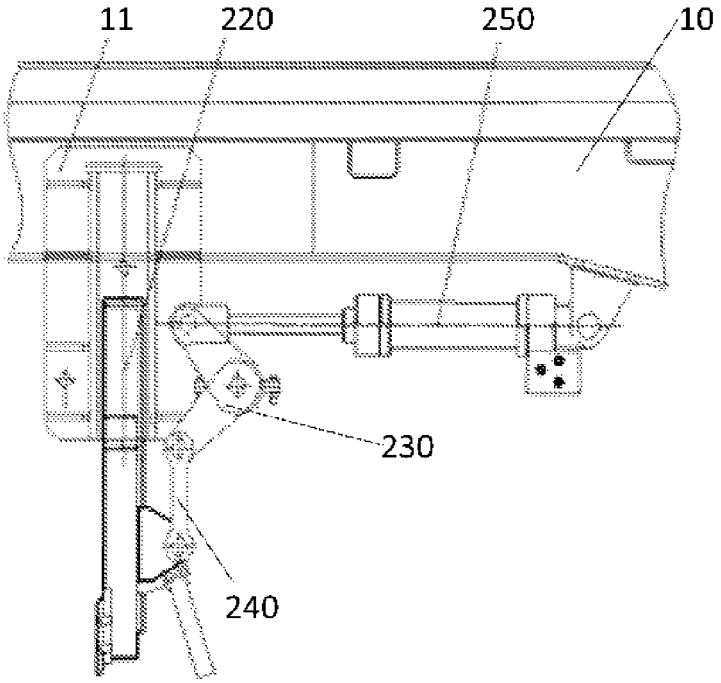
FIG. 13 is a structural schematic diagram of another state of the ballast leveling device in FIG. 12.

As shown in FIG. 13, when the ballast leveling is required, the driving part 250 is started to drive the first crank 230 to rotate so as to drive the plough piece 220 to descend through the connecting rod 240, so the plough head 224 descends, the vehicle body 10 moves, and the plough head 224 can level the ballasts without requiring manual ballast leveling, thereby solving the technical problem in the prior art that the ballasts are leveled in the manual ballast leveling mode, resulting in large labor intensity, low efficiency and harsh environment.

When no ballast leveling is required, the driving part 250 is started to drive the first crank 230 to rotate so as to drive the plough piece 220 to ascend through the connecting rod 240, so the plough head 224 ascends, and thus the plough head 224 is packed up to prevent influence on the movement of the ballast leveling device 200 and save the space occupied by the ballast leveling device 200 on the vehicle body.

The number of the plough pieces 220 can be set according to needs, for example, being set as 1, 2 or 3. Specifically, in the present embodiment, as shown in FIG. 3, two plough pieces 220 are arranged and are respectively arranged at a front end and a rear end of the vehicle body 10, the ballast unloading doors 30 are located between the plough pieces 220, in other embodiments, the plough piece 220 can be located on the rear end of the vehicle body 10, namely, the plough piece 220 is arranged in such a manner that as long as the plough piece 220 can level the ballasts after the ballasts are unloaded.

The diesel generator set 390 is used for providing a power supply for the engineering vehicle.

The engineering vehicle is controlled by the remote control device 380, an operator sends an instruction by operating a wireless remote controller or a manual valve to control the hydraulic system to work, and the extension and retraction of the piston of the hydraulic cylinder drive the opening and closing of the ballast unloading doors 30 and the ascending and the descending of the plough piece 220 so as to accomplish ballast unloading and ballast leveling operations.

Specifically, in the present embodiment, the ballast unloading door 30 includes two opposite end plates 35 and two ballast flow plates 36 connected with the two end plates 35, wherein one ballast flow plate 36 and the two end plates 35 are enclosed to form the inner unloading passage 31, and the other ballast flow plate 36 and the two end plates 35 are enclosed to form the outer unloading passage 32. Furthermore, the stop portions 33 are specifically top plates 37 connected with the two ballast flow plates 36, the shapes of the top plates 37 correspond to the shapes of the ballast unloading openings 21 to block the ballast unloading openings 21. Furthermore, a plurality of division plates 38 are arranged between the two ballast flow plates 36 at intervals.

Figure 9:
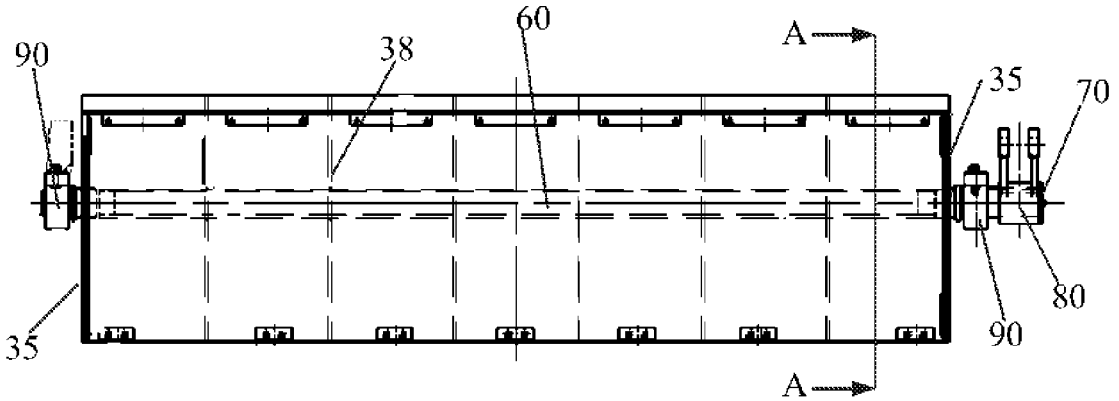
FIG. 9 is a structural schematic diagram of another embodiment of the ballast unloading door.
Figure 10:
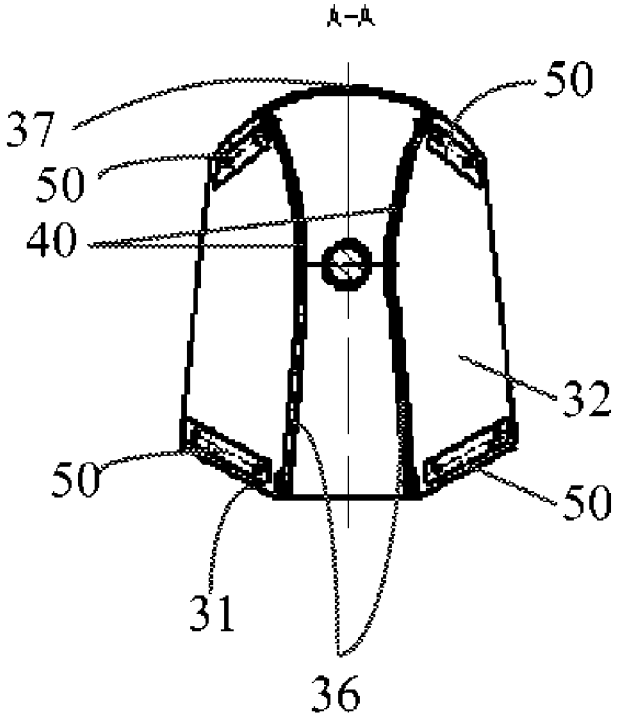
FIG. 10 is a side view of the ballast unloading door in FIG. 9.

As shown in FIG. 9 and FIG. 10, in order to reduce the noise generated by the flow of the railway ballasts during ballast unloading, the ballast unloading device 100 further includes acoustic boards 40, and the acoustic boards 40 are fixed to the end plates 35 and the ballast flow plates 36. Specifically, in the present embodiment, the ballast unloading device 100 further includes pressing strips 50 pressed on the acoustic boards 40, and the acoustic boards 40 are fixed by the pressing strips 50 by using screws and other fixing parts.

In the present embodiment, in order to realize the rotation of the ballast unloading doors 30, the ballast unloading device 100 further includes a transmission shaft 60 and a second crank 80 in fixed connection with the transmission shaft 60, the transmission shaft 60 is fixed to the ballast unloading doors 30, when the driving part is started, it drives the transmission shaft 60 to rotate through the second crank 80 so as to drive the ballast unloading doors 30 to rotate.

In addition, the ballast unloading device 100 further includes a baffle 70 and a bearing base 90, the transmission shaft 60 is fixed in the bearing base 90, the baffle 70 is fixed to the transmission shaft 60, and the second crank 80 is located between the bearing base 90 and the baffle 70 to prevent the second crank 80 from separating from the transmission shaft 60.

According to the above-mentioned engineering vehicle having the ballast unloading device, by means of one ballast unloading opening 21, and the ballast unloading doors 30 provided with the inner unloading passages 31 and the outer unloading passages 32 and including the stop portions 33 located between the inner unloading passages 31 and the outer unloading passages 32, and by means of the rotation of the ballast unloading doors 30 relative to the ballast carrying portion 20, the ballast unloading device 100 can be located at the inner unloading position, the outer unloading position or the door closing position, that is to say, the ballast unloading openings 21 can both unload the ballasts to the inner sides of the tracks and unload the ballasts to the outer sides of the tracks through the ballast unloading doors 30, thereby solving the technical problem that in order to unload the ballasts to the inner sides of the tracks and unload the ballasts to the outer sides of the tracks, inner ballast unloading openings for unloading the ballasts to the inner sides of the tracks and outer ballast unloading openings for unloading the ballasts to the outer sides of the tracks must be provided, and that the ballasts cannot be both unloaded to the inner sides of the tracks and the outer sides of the tracks by one ballast unloading opening.

In addition, to prevent the plough piece 220 from dropping suddenly after the plough piece 220 ascends, a fixing hole 12 is formed in the vehicle body 10, a locking hole 225 is formed in the plough piece 220, the ballast leveling device 200 further includes a lock pin 260, after the plough piece 220 ascends relative to the vehicle body 10, the fixing hole 12 is opposite to the locking hole 225, and the lock pin 260 is inserted into the fixing hole 12 and the locking hole 225 to relatively fix the vehicle body 10 and the plough piece 220, in order to prevent the plough piece 220 from dropping suddenly and protect the plough piece 220.

The ballast leveling device 200 further includes a sweeper 270, the sweeper 270 is used for sweeping steel rails, and the sweeper 270 is fixed to the plough piece 220 so as to ascend or descend with the plough piece 220. When the plough piece 220 descends, the sweeper 270 descends to sweep the steel rails. In the present embodiment, one end of the sweeper 270 is a rubber bar fixed to the plough piece 220, when the sweeper 270 descends, the sweeper 270 is in contact with the steel rails, and by means of the acting force between the steel rails, the distance between two rubber bar brackets increases, so that the sweeper is arranged on both sides of the steel rails so as to sweep the steel rails.

Although the preferred embodiments of the present invention have been described, those skilled in the art will be able to make additional changes and modifications to these embodiments once mastering the basic creation concept. Accordingly, the appended claims are intended to be construed as including the preferred embodiments and all changes and modifications that fall within the scope of the present invention.

Apparently, those skilled in the art can make various changes and modifications to the present invention without departing from the spirit and scope of the present invention. In this way, if these modifications and variations of the present invention belong to the scope of the claims of the present invention and the equivalent technology thereof, the present invention is also intended to encompass these modifications and variations therein.

The invention claimed is:

1. A railway ballast car having a vehicle body comprising a ballast unloading device and a ballast leveling device, wherein the ballast unloading device comprises:

a ballast carrying portion provided with ballast unloading openings, and the ballast carrying portion being arranged on the vehicle body;

ballast unloading doors capable of rotating relative to the ballast carrying portion, inner unloading passages and outer unloading passages being arranged on the ballast unloading doors, and the ballast unloading doors further comprising stop portions located between the inner unloading passages and the outer unloading passages;

wherein by means of the rotation of the ballast unloading doors relative to the ballast carrying portion, the ballast unloading doors can switch among three states:

(1) that the inner unloading passages are opposite to the ballast unloading openings;

(2) the outer unloading passages are opposite to the ballast unloading openings; and (3) that the stop portions are arranged on the ballast unloading openings;

wherein the ballast leveling device comprises: a plough piece slidably fixed to the vehicle body so as to ascend or descend relative to the vehicle body, and a plough head used for leveling ballasts being arranged on the plough piece;

a first crank rotationally fixed to the vehicle body;

a connecting rod, with one end being rotationally connected with the first crank, and the other end being rotationally connected with the plough piece; and a driving part used for driving the first crank to rotate so as to drive the plough piece to ascend or descend through the connecting rod, in order to drive the plough head to ascend or descend.

2. The railway ballast car of claim 1, wherein the ballast unloading door comprises two opposite end plates and two ballast flow plates connected with the two end plates, wherein one ballast flow plate and the two end plates are enclosed to form the inner unloading passage, and the other ballast flow plate and the two end plates are enclosed to form the outer unloading passage.

3. The railway ballast car of claim 2, wherein the stop portions are specifically top plates connected with the two ballast flow plates, and a plurality of division plates are arranged between the two ballast flow plates at intervals.

4. The railway ballast car of claim 2, wherein the ballast unloading device further comprises acoustic boards, and the acoustic boards are fixed to the end plates and the ballast flow plates.

5. The railway ballast car of claim 1, wherein the ballast unloading device further comprises a transmission shaft and a second crank in fixed connection with the transmission shaft, the transmission shaft is fixed to the ballast unloading doors, and power is transmitted to the transmission shaft by the second crank to drive the transmission shaft to rotate so as to drive the ballast unloading doors to rotate.

6. The railway ballast car of claim 1, wherein the driving part is a hydraulic cylinder, and the movement direction of a piston rod of the hydraulic cylinder is vertical to the movement direction of the plough piece.

7. The railway ballast car of claim 1, wherein the plough head is detachably fixed to the plough piece, and the thickness of the end part of the plough head away from the plough piece is smaller than the thickness of the end part of the plough head connected with the plough piece.

8. The railway ballast car of claim 1, wherein two guide slots are formed in the vehicle body, two guide rail groups are arranged on the plough piece, the two guide rail groups are respectively arranged in the two guide slots so as to slidably fix the plough piece to the vehicle body, and a wearing plate is arranged between the guide rail groups to improve the abrasive resistance of the plough piece when sliding relative to the vehicle body.

9. The railway ballast car of claim 1, wherein a fixing hole is formed in the vehicle body, a locking hole is formed in the plough piece, the ballast leveling device further comprises a lock pin, after the plough piece ascends relative to the vehicle body, the fixing hole is opposite to the locking hole, and the lock pin is inserted into the fixing hole and the locking hole to relatively fix the vehicle body and the plough piece.

10. The railway ballast car of claim 1, wherein the ballast leveling device further comprises a sweeper, the sweeper is used for sweeping steel rails, the sweeper is fixed to the plough piece, and when the plough piece descends, the sweeper descends to sweep the steel rails.

* * * * *